United States Patent [19]

Smith et al.

[11] 4,259,554

[45] Mar. 31, 1981

[54] THIN ARC RUNNER FOR ARC SPINNER INTERRUPTER

[75] Inventors: Robert K. Smith, Lansdale; Gerald A. Votta, King of Prussia, both of Pa.

[73] Assignee: Electric Power Research Institute, Palo Alto, Calif.

[21] Appl. No.: 868,623

[22] Filed: Jan. 11, 1978

[51] Int. Cl.[3] ..... H01H 33/18

[52] U.S. Cl. ..... 200/147 R; 200/146 R; 200/148 B

[58] Field of Search ..... 200/147 R, 147 A, 148 B, 200/146 R

[56] References Cited

U.S. PATENT DOCUMENTS

| | | | |
|---|---|---|---|
| 4,032,736 | 6/1977 | Ruffieux et al. | 200/147 R |
| 4,052,576 | 10/1977 | Smith | 200/146 R |
| 4,086,461 | 4/1978 | Gonek | 200/146 R |
| 4,109,124 | 8/1978 | Boersma et al. | 200/148 B |
| 4,153,827 | 5/1979 | Mircovich et al. | 200/147 R |

FOREIGN PATENT DOCUMENTS

| | | | |
|---|---|---|---|
| 241819 | 11/1962 | Australia | 200/147 A |
| 2511238 | 9/1975 | Fed. Rep. of Germany | 200/147 R |

*Primary Examiner*—Robert S. Macon
*Attorney, Agent, or Firm*—Ostrolenk, Faber, Gerb & Soffen

[57] ABSTRACT

An arc runner structure is described for an arc spinner type of interrupter wherein the arc runner is in series with an electrical coil which is closely coupled to the arc runner. The coil current and a circulating current induced in the arc runner produce a magnetic field in an arcing space where the magnetic field interacts with the arc current to produce a Lorentz force which rotates the arc around the arc runner and relative to a cool static dielectric gas, in order to extinguish the arc. A high Lorentz force is desired since this produces a higher arc spinning speed and thus improved interruption operation. The magnetic field strength produced, and its relative phase shift with respect to the arc current, is controlled by the inductance of the arc runner, its mutual coupling to the coil and the resistance of the arc runner. These parameters determine the induced current in the arc runner for a given configuration. The arc runner thickness is intentionally made less than that which would give the maximum induced current at arc current zero, thereby to obtain the maximum rotating force on the arc in the interval near the arc current zero.

17 Claims, 19 Drawing Figures

0.7
0.6
0.5
0.4
0.3
0.2
0.1
0.0
RADIAL FLUX DENSITY 1" OFF COIL AXIS IN GAUSS PER PEAK COIL AMPERE
TM, THICKNESS WHICH PRODUCES THE MAXIMUM VALUE OF INDUCED CURRENT AT THE ARC CURRENT ZERO
I COIL = 0
I COIL = 0.7 I PEAK
I COIL = I PEAK
3/32
5/32
1/4
11/32
13/32
1/2
ARC RUNNER THICKNESS IN INCHES

THIN ARC RUNNER FOR ARC SPINNER INTERRUPTER

RELATED APPLICATIONS

This application is related to copending applications Ser. No. 868,624, filed Jan. 11, 1978 in the names of Lorne D. McConnell, Gerald A. Votta and Donald E. Weston, entitled Moving Contact for Radial Blow-in Effect for Arc Spinner Interrupter; Ser. No. 868,623, filed Jan. 11, 1978 in the name of Robert Kirkland Smith, entitled Exterior Connected Arc Runner for Arc Spinner Interruptor; and Ser. No. 868,622, filed Jan. 11, 1978, in the names of Ruben D. Garzon, Lorne D. McConnell and Gerald A. Votta, entitled Moving Contact for Localized Gas Flow Arc Spinner Type Interrupter, all of which are assigned to the assignee of the present invenion.

BACKGROUND OF THE INVENTION

This invention relates to circuit interrupters, and more specifically relates to a novel arc runner construction for the arc runner of an arc spinner type of circuit interrupter.

Arc spinner type interrupters are known in the art and are typically shown in U.S. Pat. No. 4,052,577, in the name of Gerald A. Votta, as well as U.S. Pat. No. 4,052,576, in the name of Robert Kirkland Smith.

In these devices, a flat conductive ring, hereinafter called the arc runner, is provided which is disposed in a plane perpendicular to the axis of the interrupter and perpendicular to the flow of arc current during circuit interruption. This arc runner is then electrically connected in series with a coil to which it is closely coupled. A movable contact is then arranged to make annular contact engagement and disengagement with a cooperating annular surface of the arc runner facing away from the coil. When the contact opens, an arc is drawn from the arc runner to the movable contact and the arc current flows through the coil. This then induces a circulating current in the arc runner, which is a shorted turn, and both the arc runner and coil then produce a resultant magnetic field in the region of the arc.

The magnetic field component from the arc runner circulating current is displaced in phase from that of the coil so that a fairly substantial field is present just before a current zero interval. The effect of the arc current in the magnetic field produced by the arc runner and coil is such that a Lorentz force is established which tends to rotate the arc around the arc runner. This rotational movement of the arc is through a relatively static dielectric gas which fills the arc space and thereby tends to deionize and cool the arc so that the arc can be interrupted at the first current zero.

The faster the arc spins in the gas, the better will be the arc cooling and deionization effect. In order to produce the maximum Lorentz force on the arc, it has heretofore been thought desirable to produce the maximum circulating current in the arc runner since it is this component that produces the out-of-phase magnetic field component in the arc space which is present just before the current zero interval is reached. It has been found, however, that this does not produce the maximum rotating force on the arc and has not produced, therefore, the most efficient deionization and cooling of the arc.

BRIEF DESCRIPTION OF THE PRESENT INVENTION

In accordance with the present invention, the arc runner thickness is chosen to maximize the radial flux density measured close to the arc runner at the time when the arc current reaches zero. Thus, the force rotating the arc through the gas is maximized near current zero to provide efficient cooling to the arc and produce arc interruption. Flux density at arc current zero is produced by the current induced in the arc runner which is phase-shifted in time from the arc (coil) current. It would be expected that by choosing the arc runner thickness to maximize the magnitude of induced current at arc current zero, that the flux density at this critical time would also be maximized. However, a thinner arc runner with a smaller magnitude of induced current at arc current zero will result in a maximum current zero flux density. Thus, the arc runner thickness is chosen to maximize current zero flux density and is intentionally made less than that which give maximum induced current magnitude at arc current zero, thereby to obtain the maximum rotating force on the arc in the interval near current zero. Moreover, the decrease in the maximum induced current in the arc runner will decrease the repulsion force between the arc runner and the coil and thereby permits mechanical simplification in the assembly of the device.

DETAILED DESCRIPTION OF THE DRAWINGS

Figure 1:
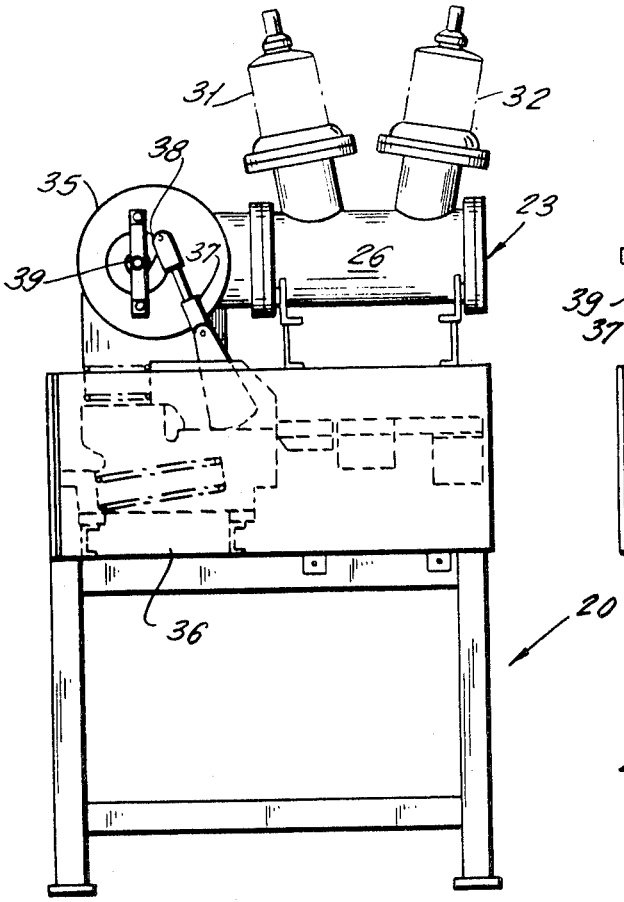
FIG. 1 is a side elevational view of a circuit breaker which could incorporate the concept of the present invention.
Figure 2:
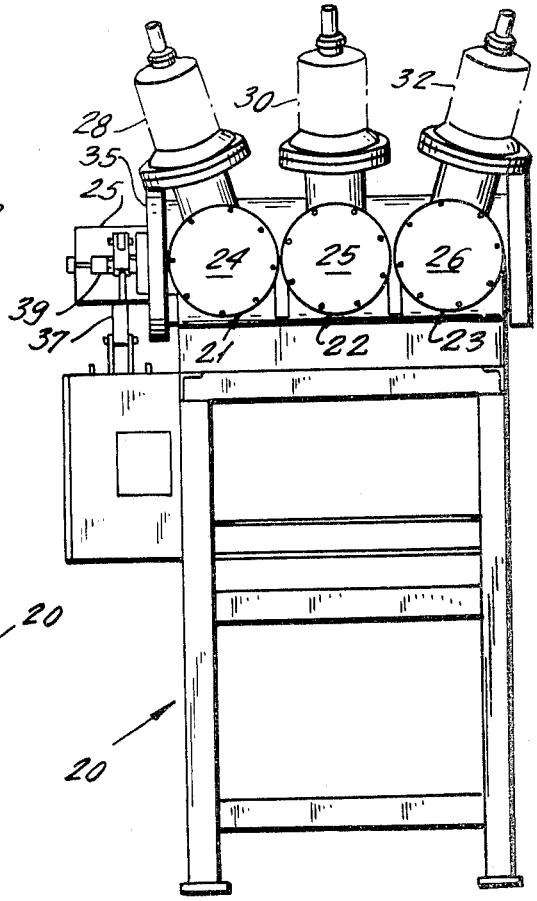
FIG. 2 is a front elevational view of FIG. 1.
Figure 4B:
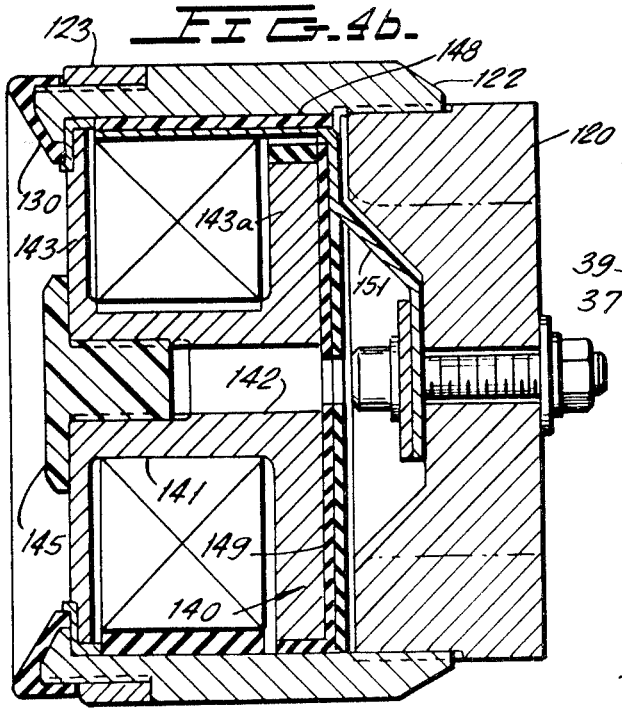
FIG. 4*b* is an enlarged cross-sectional diagram of the coil assembly of FIG. 4.
Figure 3:
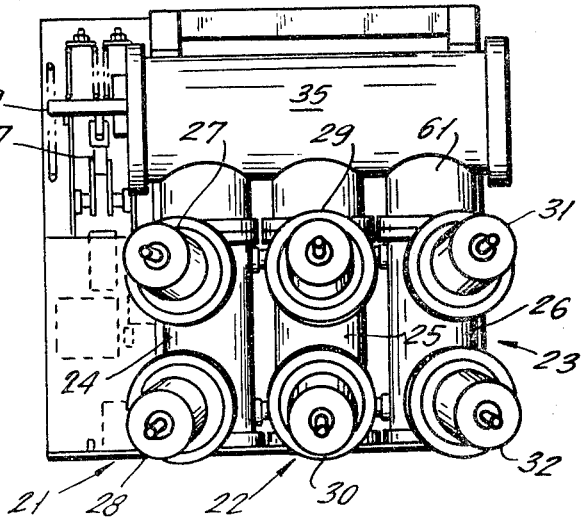
FIG. 3 is a top view of FIGS. 1 and 2.

FIGS. 1 to 3 illustrate a typical circuit breaker which uses circuit interrupters of the type constructed in accordance with the present invention. Referring to FIGS. 1 to 3, the circuit breaker is mounted on a steel support frame 20 and is shown as a three-phase circuit breaker containing phases 21, 22 and 23. Each of phases 21, 22 and 23 consist of identical interrupters, one of which will be described more fully hereinafter, contained in respective aluminum tanks 24, 25 and 26, which have terminal bushings 27–28, 29–30 and 31–32, respectively. Each of housings 24, 25 and 26 are capped at their right-hand end in FIG. 1 and communicate with an operating mechanism housing 35, which may include a jack-shaft linkage which is coupled to the interrupters within each of housings 24, 25 and 26. The operating mechanism is operable to simultaneously open and close the three interrupters. Any suitable spring closing mechanism or the like, shown as the spring closing mechanism 36, can be used to apply the input energy for the jack-shaft linkage in housing 35. Thus, an operating link 37 extending from the spring mechanism 36 is connected to an operating link 38 (FIG. 1) which in turn rotates shaft 39 which is coupled to the interrupters of each phase as will be more fully described hereinafter.

It is necessary that the housing 35 be sealed since it will be filled with a suitable dielectric gas such as sulfur hexafluoride and permits communication of the insulating gas between the interiors of all housings 24, 25 and 26.

The circuit breaker described above is suitable for use in connection with a 15kV/25kA three-phase circuit breaker and can have a total height of about 82 inches and a total width in FIG. 1 of about 38 inches.

Figures 4, 4A:
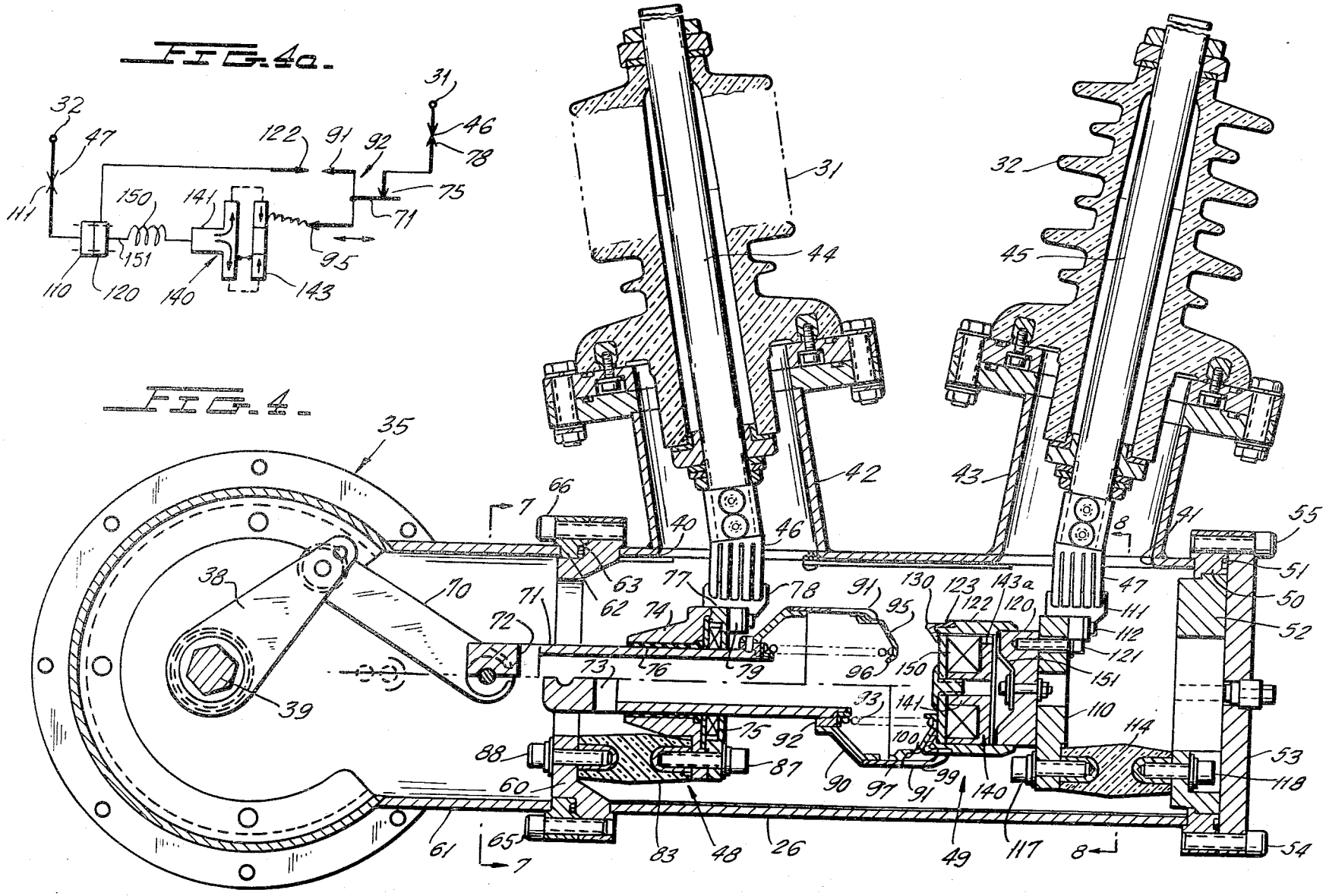
FIG. 4 is a cross-sectional view taken along the axis of one of the three interrupters of FIGS. 1, 2 and 3 and illustrates an interrupter with a center-fed arc runner and shows the interrupter open above the center axis and closed below the center axis.
FIG. 4*a* is an electrical circuit diagram of the structure shown in FIG. 4.

The interior of the interrupter for each phase is shown in FIG. 4 for the case of phase 23 encased by housing 26. Housing 26 may be of steel or of any other desired material and contains two openings 40 and 41 for receiving the bushings 31 and 32. Thus, openings 40 and 41 have short tubes 42 and 43, respectively, welded thereto, which tubes receive suitable terminal bushings 31 and 32 in any desired manner.

The terminal bushings 31 and 32 then have central conductors 44 and 45, respectively, which are terminated with jaw type contacts 46 and 47, respectively, which receive movable contact assembly 48 and stationary contact assembly 49, respectively, as will be later described.

Figure 5:
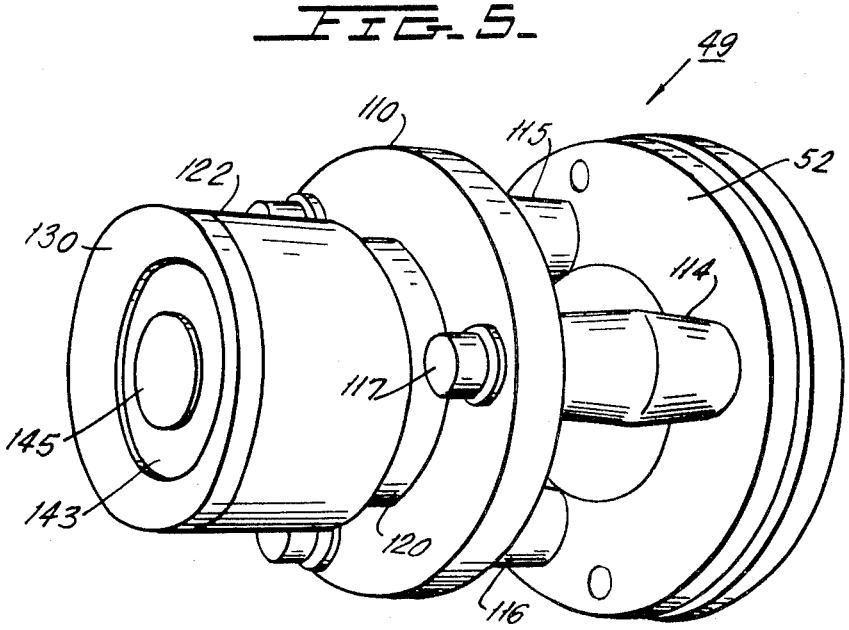
FIG. 5 is a perspective view of the stationary contact and arc runner shown in FIG. 4.
Figure 9:
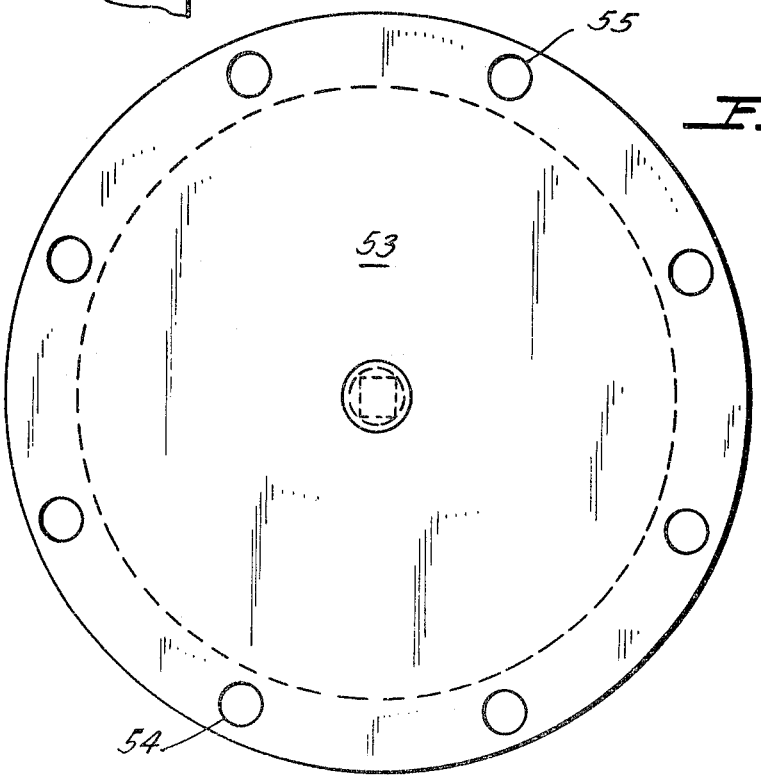
FIG. 9 is an end view of the right-hand end of FIG. 4.

The right-hand end of housing 26 is capped by an end assembly including seal ring 50 (FIG. 4) which contains a sealing gasket 51 (FIG. 4), an aluminum support plate 52 (FIGS. 4 and 5) and an end cap plate 53 which may be of steel. Ring 50 is welded to the right-hand end of tube 26 and provides a bolt-hole ring. The aluminum disk 52 is held in the position shown by the plate 53 when the plate is bolted to the ring 50 as by the bolts 54 and 55 shown in FIG. 4. Note that plate 53 is shown in both FIG. 4 and FIG. 9 and, when the plate 53 is bolted up against the ring 50, it forms a leak-proof seal against the sealing ring 51.

Figure 7:
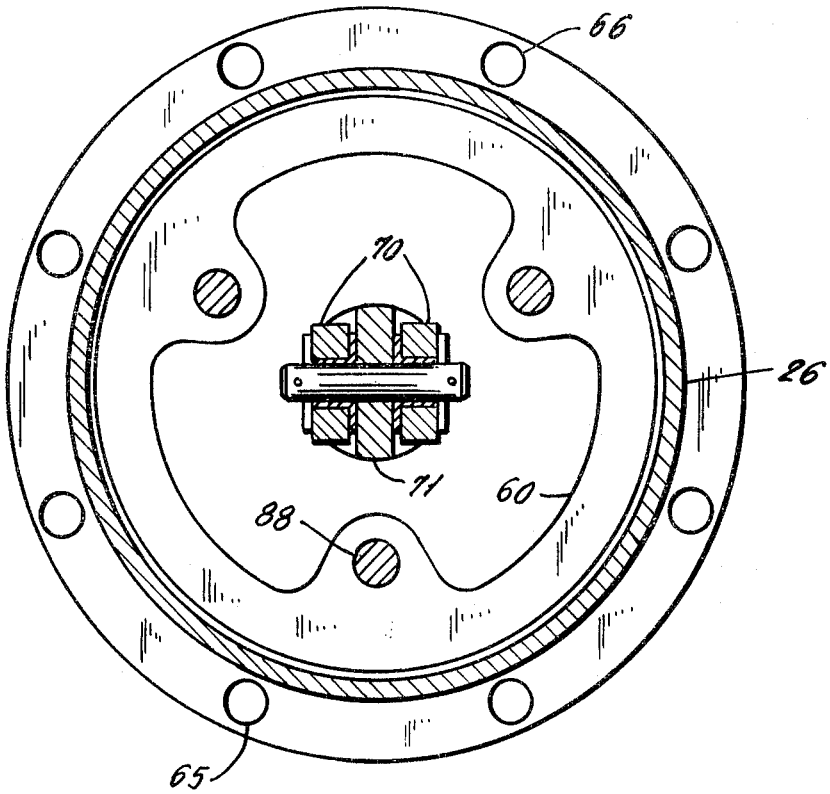
FIG. 7 is a cross-sectional view of FIG. 4 taken across the section line 7—7 in FIG. 4.

The opposite end of tube 26 has a bolt ring 60 welded thereto which has a three-lobe type opening as best shown in FIG. 7. A short tube section 61 is then provided with a sealing ring 62 connected to its end which receives a sealing gasket 63. The outer diameter of ring 62 contains a bolt ring circle having bolt openings in alignment with the bolt openings in member 60 so that bolts, such as bolts 65 and 66 in FIGS. 4 and 7, can secure together housing sections 26 and 61 with a good gas-tight seal being formed by the seal 63.

The left-hand end of section 61 is then welded into an opening in the tank 35 as shown. Thus, the interior of tube 26 and of the various elements with which it communicates are sealed from the external atmosphere and the interior of tube 26 is filled with sulfur hexafluoride at a pressure of about 3 atmospheres absolute. Note, however, that any desired pressure could be used and that any dielectric gas other than sulfur hexafluoride or combinations of dielectric gases as desired could be used in place of sulfur hexafluoride.

Figure 6:
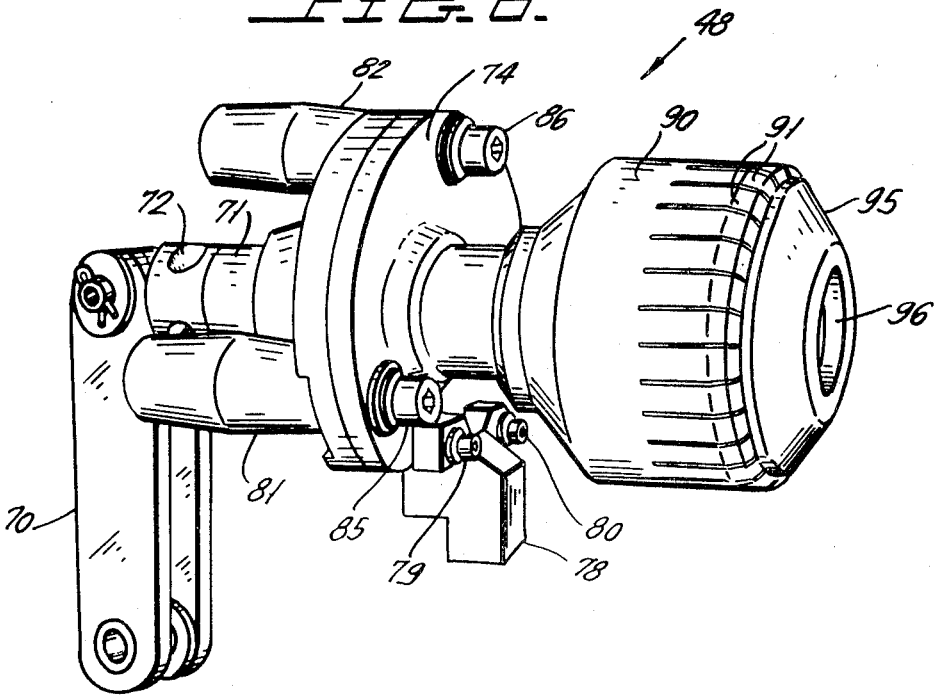
FIG. 6 is a perspective view of the movable contact assembly of FIG. 4.

The movable contact assembly 48 is best shown in FIGS. 4 and 6. The movable contact assembly is connected to the operating crank 38 of FIG. 4 which is driven by the operating mechanism through a connecting link 70 which is pivotally connected to the end of elongated axially movable conductive member 71. Movable member 71 is a conductive elongated hollow rod having a closed end at its left where the closed end portion at its left-hand end is provided with a plurality of vents such as vents 72 and 73 which, as will be described hereinafter, permit flow of gas and arc plasma through the movable contact and through these vents during an interruption operation.

Movable member 71 is guided for motion by a stationary conductive support member 74 which contains a sliding contact member 75 (FIG. 4) which maintains electrical sliding contact with the conductive tube 71. A suitable insulation layer 76 (FIG. 4) can be fixed to member 74 to provide relatively low friction guiding of the movable member 71. Contact 75 is then held in place by a suitable conductive backup plate, such as plate 77, which is held in place by suitable screws.

Conductive stationary support member 74 is also provided with an upwardly extending conductive tab 78 which is fixed to member 74 by bolts 79 and 80 (FIG. 6) and the tab 78 engages the jaw contact 46 when the device is assembled. The support member 74 is then fixed to the ring 60 by three insulation support members 81 and 82 (FIG. 6) and 83 (FIG. 4) which may be molded epoxy members. The right-hand end of each of these members is bolted to member 74 as by bolts 85, 86 and 87, respectively, and their opposite ends are bolted to member 60 as by the bolt 88 shown in FIG. 4 for the case of insulation support member 83. Similar bolts connect the other insulation supports to the member 60 but are not shown in the drawings. Thus, the movable contact assembly is insulatably supported from the housing 26.

The main movable contact element then consists of a bulbous movable contact member 90 which is terminated by a plurality of segmented contact fingers 91.

Member 90 defines an outwardly looping current path from the centrally located conductive member 71 and may be suitable electrically connected to the end of member 71 as by a threaded connection to the intermediate conductive ring 92 which is, itself, threaded to the end of member 71. Intermediate member 92 also serves as a seat for compression spring 95 which is pressed against the inner diameter of the interior sliding arcing contact member 95. Arcing contact 95 has a central opening 96 at its outer diameter and receives a suitable nonconductive ring 97 which enables member 95 to slide relatively easily with the fingers 91. Note that the ends of fingers 91 bend inwardly to define a shoulder 99 which engages the shoulder 100 when the fingers move to the left while the interrupter is opening.

Figure 8:
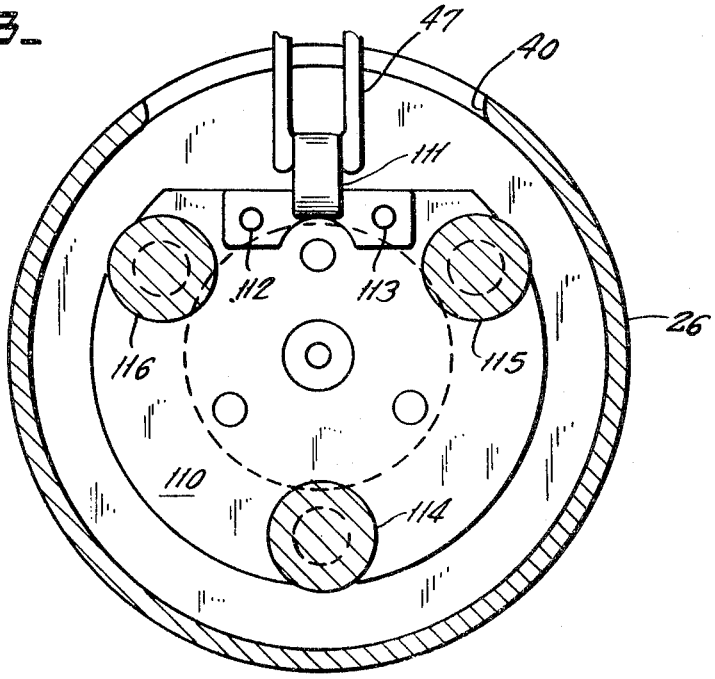
FIG. 8 is a cross-sectional view of FIG. 4 taken across the section line 8—8 in FIG. 4.

The stationary contact structure 49 is best shown in FIGS. 4 and 8. Stationary contact structure 49 has a main support housing section 110 which may be of aluminum and has a tab 111 extending therefrom and bolted thereto as by the bolts 112 and 113. Tab 111 is then received by the jaw contact 47 to make connection between the stationary contact assembly and the terminal bushing 32.

Support member 110 then has three epoxy support members 114, 115 and 116 bolted thereto as by bolts such as the bolt 117 shown in FIG. 4 for the case of member 114. The support members 114 to 116 are then in turn bolted to the aluminum disk 52 as by bolts such as bolt 118 shown in FIG. 4 for the case of member 114. Thus, the entire stationary contact assembly is insulatably secured from the main support casing 26.

Member 110 has an intermediate aluminum support member 120 (FIGS. 4 and **4*b*) bolted thereto as by bolts such as bolt 121 shown in FIG. 4 and a main stationary contact sleeve 122 is threadably connected or otherwise suitably connected to the member 120. The end of member 122 may have a contact ring insert 123 which may be of a material which can resist arc erosion, such as copper-tungsten or the like for receiving the inner ends of contact fingers 91 of the movable contact when the interrupter is closed, and for forming a good solid low-resistance current conduction path between contact assemblies 48 and 49. Note that fingers 91 are outwardly and elastically pressed when they engage member 122 to provide high pressure contact. The end of the contact sleeve 122 is then terminated by a Teflon ring 130 which generally covers the outer end of the stationary contact assembly and has the generally trapezoidal cross-sectional shape shown. Ring 130 can be secured in place relative to sleeve 122** as by threading or the like.

The stationary contact assembly shown in FIG. 4 further contains a copper coil support member 140 (see FIG. **4*b*) which consists of a central core section 141 which has a central opening 142 therein, and two integral spaced flanges 143 and 143*a* extending from core 141. Flange 143 acts as an arc runner and is a generally washer shaped conductive plate which may be of a chromium copper material. Rear flange 143*a* is preferably slotted to discourage circulating current. Coil support 140 should be sufficiently strong to withstand forces of repulsion which tend to repel the coil winding and the arc runner 143. A Teflon or other insulation material nut 145 covers the interior surface of arc runner 143 and defines an annular shaped exposed contact area for arc runner 143**.

Insulation members 148, 149 and **149*a* are disposed between copper coil support member 140 and sleeve 122 to prevent their accidental contact. The space between arc runner 143 and flange 143*a* receives a winding 150 which is a spiral winding, for example, consisting of eleven concentric flat turns which are insulated from one another. If desired, the turns of winding 150 can be made of other cross-section shapes, and could, for example, be square in cross-section. The interiormost coil of winding 150 is electrically connected to the central hub 141 while the outermost coil of winding 150 is electrically connected to member 120 by the conductive strap 151. Thus, an electrical connection is formed from terminal 111 (FIG. A) through member 110, member 120, conductive strap 151, winding 150, and to the hub 141 of member 140. In the embodiment of FIG. 4, current is connected to arc runner 143 at its interior. Current is introduced into hub 141 from coil 140, and is then connected directly to the interior diameter of arc runner 143**.

Figure 10:
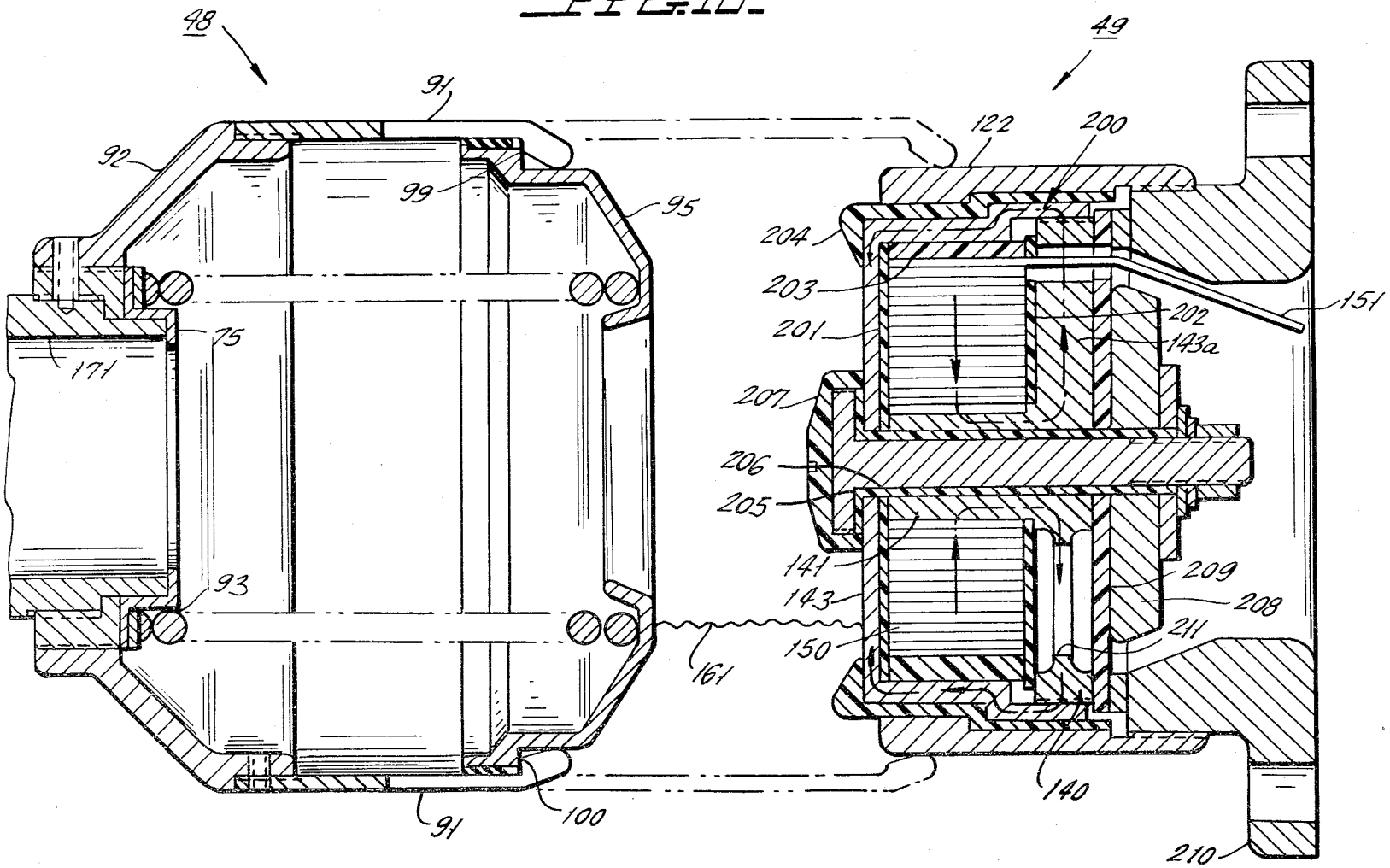
FIG. 10 is an enlarged view of the stationary contact and arc runner of FIG. 4 modified in accordance with the invention so that current to the arc runner is connected at its outer diameter.

An important feature of this invention, as will be shown in connection with FIG. 10, is that there can be an outside feed of current to arc runner 143, whereby the outer diameter of flange **143*a* is connected to the outer diameter of the arc runner 143. The current path for either inside or outside feed to arc runner 143 is schematically shown in FIG. 4*a*. Suitable insulation layers are provided as necessary to define the inside or outside-fed connection to the arc runner 143. FIG. 10**, which will be later described, shows the outside feed in detail.

In the construction described to this point, it can be seen that the assembly of the interrupter is simplified by the removable connection between the movable and stationary contact assemblies 48 and 49 with the jaw contacts 46 and 47 for the terminal bushings 31 and 32.

The current path through the interrupter, when the interrupters are in the closed position shown below the center line in FIG. 4, is as follows:

Current enters terminal 31 and flows through jaw contact 46 and tab 48 and is then connected to the conductive member 71 through the sliding contact 75. Current then flows axially outwardly into movable contact member 90 and then through the contact fingers 91 and into contacts 123 and 122. Current then continues to flow into member 120 and member 110 and then through the tab 111 into the the jaw contact 47 and then out of the bushing 32.

In order to open the interrupter contacts, the operating mechanism causes link 38 to rotate counterclockwise in FIG. 4, thereby moving conductive member 71 to the left. During the initial opening motion, the contact fingers 91 move to the left in FIG. 4 so that the main contacts open and electrical current flow is commutated from the main contact into the arcing contact 95, which is still engaged with the arc runner 143, coil 150, and then through members 120 and 110 to tab 111.

Contact 95 may be of a copper chromium material or some other material well suited to withstand arcing duty. The arcing contact 95 is initially strongly held against the arc runner 143 under the influence of the spring 93. Once the movable contact fingers 91 have moved sufficiently far to the left, however, shoulder 99 of the fingers 91 pick up shoulder 100 of arcing contact 95 and, for the first time, the arcing contact 95 beings to move to the left, and out of contact with arc runner 143. An arc is then drawn between the arc runner surface 143 to the arcing contact 95 which arc current flows in series with the coil 150.

The current through coil 150 then sets up a magnetic field which has a component extending perpendicularly through the arc current flowing between arc runner 143 and contact 95. At the same time, since coil 150 is very closely coupled to the arc runner 143 (which is a short-circuited turn), a circulating current is induced in the arc runner 143. This circulating current is phase-shifted relative to the arc current and the current in coil 150. The current in the coil 150 and the circulating current in runner 143 produce a magnetic field in the arc space, which field has a component which is perpendicular to the arc current. The arc current and the magnetic field interact to produce a Lorentz force on the arc, thereby causing the arc to rotate rapidly around the axis of runner 143 and contact 95. Consequently, the arc spins rapidly through the relatively stationary dielectric gas, thereby to cool and deionize the arc so that it will extinguish at current zero.

Improved operation is obtained when current applied to the arc runner 143 is applied at its outer diamter, so that a blow-in magnetic force is applied to the arc current, causing it to bend toward the axis of rotation of the interrupter.

Figure 11:
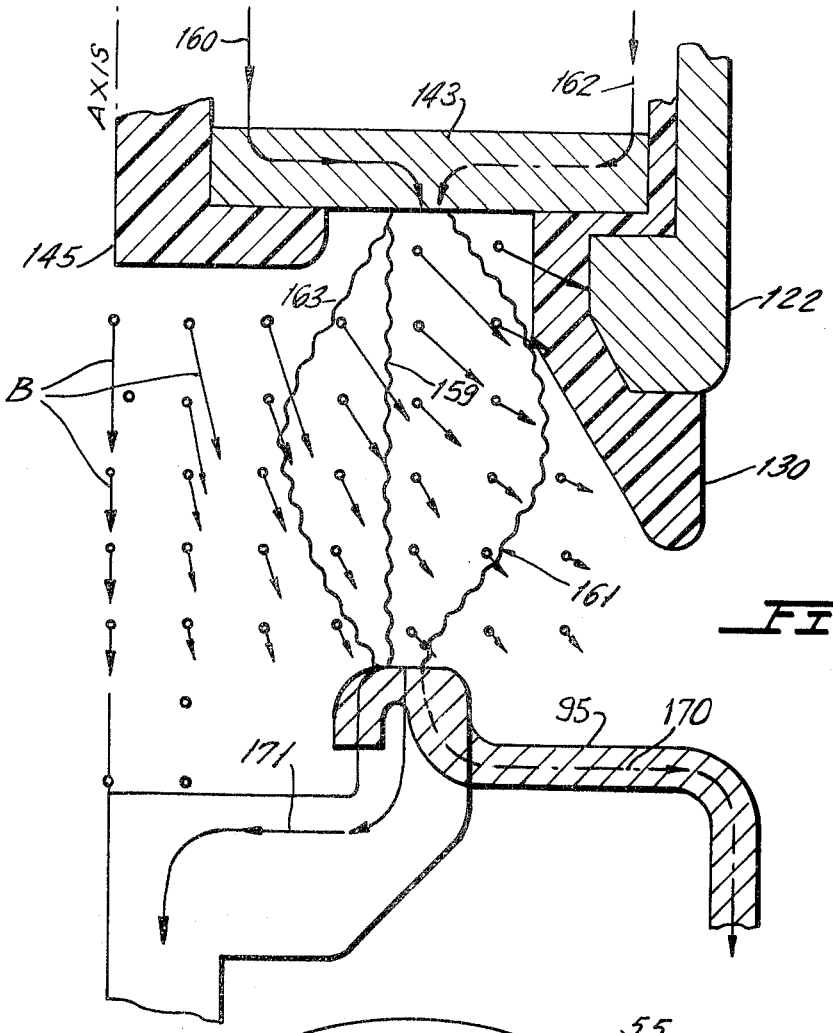
FIG. 11 schematically illustrates the arc current between the arc runner and the movable arcing contact for different conditions of current feed to the inside and outside of the arc runner and further shows different conditions of current flow, for inside feed and outside feed to the arcing contact.

The effect of the outside feed to the arc runner can be best understood by a consideration of FIGS. 10 and 11. FIG. 11 schematically illustrates a few of the disclosed stationary contact assembly components.

FIG. 10 shows the movable contact assembly 48 of FIG. 4 along with a stationary contact assembly 49 which is modified for outside feed of current. Thus, in FIG. 10, arc runner 143 is modified to have a cup shape, and has cylindrical wall 200 which extends coaxially over winding 150, and is threadably engaged to the outer periphery of flange 143*a*. Suitable insulation disks 201 and 202 and insulation cylinder 203 insulate coil 150 from cylindrical wall 200, runner 143 and flange 143*a*. Insulation sleeve 204 insulates contact sleeve 122 from the conductive wall 200.

Lead 151 is connected to the outermost coil of winding 150, and its innermost coil is connected to hub 141. The arc runner 143 is mechanically held closely coupled to coil 150 by steel bolt 205 which is sheathed with insulation, such as Teflon cylinder 206 and Teflon cap 207. Bolt 206 presses against plate 208 and insulation disk 209 as shown.

Contact 122 in FIG. 10 is threaded onto a conductive support 210 which, as in FIG. 4, is suitably connected to member 110 and terminal bushing 32.

It should be noted that flange 143*a* is slotted as by slot 211 at one or more places on its periphery to avoid inducing a circulating current around flange 143*a*.

It will be clear from FIG. 10 that the current path to arc runner 143 will follow the path of the arrows so that current will be connected to runner 143 around its full outer periphery. The effect of this outside feed of current is best understood from FIG. 11 which schematically shows the arc runner 143 for different current feed conditions.

FIG. 11 illustrates, by graduated arrows, the magnetic flux density field B plotted across the pertinent regions of the area through which the arc between arc runner 143 and movable arcing contact 95 will travel. It will first be noted that the intensity of the magnetic field is greatest closest to the arc runner 143. This is because the magnetic field B is produced by the circulating current in member 143 and also by the coil 150 which is disposed behind member 143. Thus, as the distance from coil 150 and member 143 increases, the field strength is reduced. At the same time, the direction of the field vector varies over the area and is seen to be parallel to the interrupter axis at regions along the central axis of member 143 and then becomes closer to a perpendicular to the axis of member 143, progressing radially outward from the axis.

The force which is exerted on the arc current drawn between arc runner 143 and movable arcing contact 95 is given by the vector cross product between the magnetic field B and the arc current. Thus, the closer to perpendicular the arc current is to the field vector, the greater will be the force tending to rotate the arc around the annular arc runner area.

If the current coming into arc runner 143 was straight and parallel to the central axis of runner 143 and in the absence of other disturbing forces, the arc current would take the path 159. Thus, the arc current would have a relatively large component perpendicular to the various field vectors B to produce a rather high rotating force.

In the prior art, however, current is introduced to the arc runner 143 at the inside diameter of the arc runner. Thus, current has taken the path shown in the solid line 160. Because of the bend in the current 160, a magnetic blow-off force will be exerted on the arc current, and the arc current will follow the outwardly bowed path 161. Because of this, the arc current in the high field region near the arc runner 143 will be more parallel to the magnetic field vector B, so that a relatively low rotating force will be applied to the arc current. Moreover, the arc 161 is outwardly blown, thus leading to the possible danger that the arc will transfer back to the main contact 122.

In accordance with the invention, the current feed is to the outside of the arc runner 143, as shown by the dotted-line path 162 in FIG. 11. This then produces a blow-in or inward magnetic force on the arc, which is directed toward the axis of the arc runner 143, thereby to cause an inward bowing of the arcing current as shown by the arc current path 163. Note that the maximum inward bowing occurs closest to the arc runner 143, where the magnetic field B is the highest. Thus, in these very high intensity regions, the arc current is almost perpendicular to the magnetic field, thus producing extremely high rotating forces on the ac. Moreover, the arc 163 is blown away from the outside, thereby minimizing the danger of a flashover to the main contact members.

The opposite end of the arc root is on the arcing contact 95 as shown in FIG. 11. An important aspect of the new device is that the current flow through the arcing contact 95 is radially outward, and over the dotted-line path 170 rather than the prior art type of inside feed to the arcing contact, shown in the solid line 171 path.

By causing the current path through the arcing contact to be an outside feeding path, current in the moving contact 95 flows in the radially outward path from the arc root region and from the axis of the movable contact. Thus, there is an inward blow-off force applied to the arc root and to the arc in the region of the arcing contact 95. That is to say, the arc will tend to be moved inwardly toward the axis of the arcing contact 95 rather than outwardly, as would occur for an inside feed along the path 171 as in the prior art. This tends to maintain arc position on the most radially inward portion of the arcing contact so that arc position and arc length is maintained to minimize arc energy input to the gas and to prevent a flashover to the main contact.

It was previously pointed out, with respect to FIGS. 4 and 6, that the movable contact member 71 had openings such as openings 72 and 73 therein. Other openings are also distributed around the left-hand end of member 71. It has been found that these openings will assist in the removal or distribution of arc plasma which is produced during arcing. Thus, it has been found desirable to have some means for directing the arc plasma away from the arc zone during the interruption operation in order to move the arc plasma away from the main stationary contact.

By providing openings 72 and 73 or other similar openings along the length of conductor 71, the intense heat produced by the plasma in the region between the separating contact 95 and runner 143 will act as a source to cause hot gases to move to the left along the axis of the tube 71 and then out through the openings of the tube. That is to say, the openings, such as openings 72 and 73, help define a flow channel along the center of the moving contact along which the hot gases can move in order to remove excess hot gases from the arcing zone.

This is extremely useful at higher current levels, where large amounts of hot gases are produced. It also has limited use in connection with low current interruption where a limited amount of hot gas is produced. However, in the case of low current interruption, it is useful to provide means for producing a negative pressure region within contact 71 to permit movement of at least a limited amount of gas away from the arc zone. This could be accomplished, for example, by blocking substantially the full interior of conductor 71 with a light insulation filler material and leaving a relatively small gas volume sufficient only to allow full movement of the arcing contact 95 to the right, relative to the movable contact when the contact opens. This limited movement will then cause a proportionally large increase in the volume to the left of contact 95 during opening, thereby to produce a negative pressure zone into which a limited amount of gas could flow under low current interruption conditions.

The arc runner 143 is a crucial element in the design and successful performance of the gas-filled magnetic arc spinning interrupter. Arc runner thickness is an important parameter to specify for optimum performance. In the past, the thickness was selected to be that which would give maximum induced current. However, in accordance with this invention, the choice of thickness is made to balance the desired effect of a high magnetic flux density which provides the driving force on the arc against the undesired effects of high repulsive forces between the coil and arc runner and the low strength inherent in thin material cross-sections.

Figure 12:
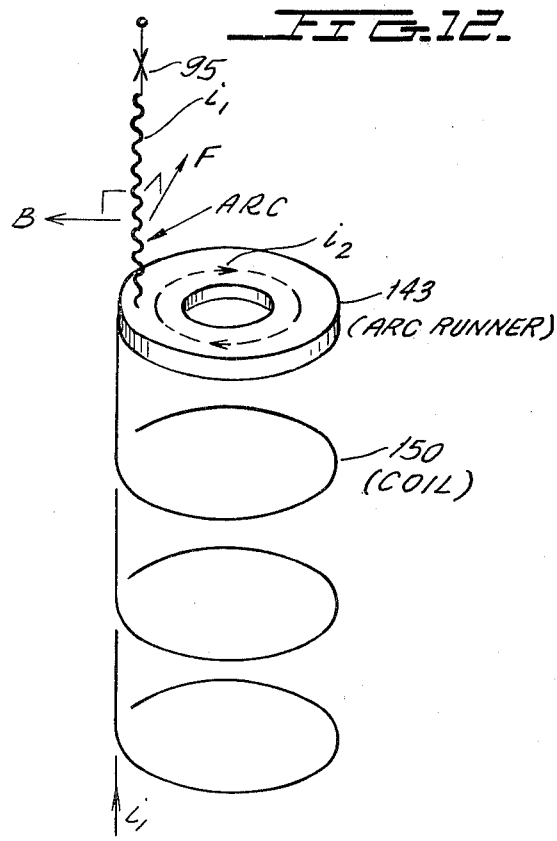
FIG. 12 schematically illustrates the coil assembly including the arc runner and coil of the foregoing figures to assist in the analysis which leads to the present invention.

The arc runner 143 and coil 150 of the preceding figures ae schematically shown in FIG. 12. Arc runner 143 of FIG. 12 is a flat ring of metal similar in shape to a washer. It is preferably of a high conductivity, arc-resistant metal such as an alloy of copper and chromium. Typically, coil 150 will have eleven concentric turns of flat conductive material and runner 143 may have an outer diameter of about 3 inches and an inner diameter of about ½ inch. Coil 150 and runner 143 are coaxial, and are as closely coupled as possible. The thickness of runner 143 will be determined in accordance with the invention.

Runner 143 is one terminal of the arc formed upon separation of the interrupter contacts including contact 95. The current $i_1$ to be interrupted is fed to the arc runner 143 from coil 150 which is adjacent to and coaxial with the runner 143. A magnetic field B, produced by the assembly of coil 150 and runner 143, interacts with arc current $i_1$ to produce a Lorentz force on the arc which tends to move the arc through a dielectric gas and to rotate the arc around the axis of runner 143. The relative motion between the arc and the stationary gas provides the cooling needed to extinguish the arc. The arc runner 143 functions physically to provide a circular path for the arc motion.

The arc runner also plays a part in producing the field B. Thus, runner 143 has a circulating current $i_2$ induced in it by coil 150. This circulating current $i_2$ contributes to the flux density B and is phase-shifted in time from the arc current $i_1$. Since current $i_2$ is phase-shifted, it has its largest impact on field B around the time of current zero for current $i_1$. Hence the induced current $i_2$ in the arc runner has a major effect on the arc interruption process.

Current is induced in the arc runner by inductive mutual coupling between the coil 150 and the arc runner 143 and its time relationship to the arc current $i_1$ is determined by the impedance parameters of runner 143. The driving voltage for current $i_2$ is induced in the ring by the current $i_1$ in the coil 150 through the mutual inductance M between the coil and the arc runner. The driving voltage e(t) as a function of time is $$e(t) = -M\frac{d_{i1}(t)}{dt} \tag{1}$$

For a sinusoidal current $i_1$, the induced voltage will be shifted in time by 90 electrical degrees. The resistance R and inductance L of runner 143 determine the form of the induced current as indicated by the differential equation:

$$R\,i_2(t) + L\frac{d_{i2}(t)}{dt} = -M\frac{d_{i1}(t)}{dt}. \tag{2}$$

For a transient coil current $$i_1(t) = \begin{cases} O & ,t < 0 \\ I_m \sin \omega t, & t \geqq 0 \end{cases} \tag{3}$$

This results in $$i_2(t) = \frac{\omega M I_m}{(R^2 + (\omega L)^2)^{\frac{1}{2}}}\left\{\cos\left[\omega t + \tan^{-1}\left(\frac{-\omega L}{R}\right)\right] - \frac{R}{(R^2 + (\omega L)^2)^{\frac{1}{2}}}\, e^{-(Rt/L)}\right\} \tag{4}$$

The phase-shift between $i_1$ and $i_2$ is observed in the argument of the cosine function. The importance of the runner impedance parameters R and L are apparent.

Figure 13:
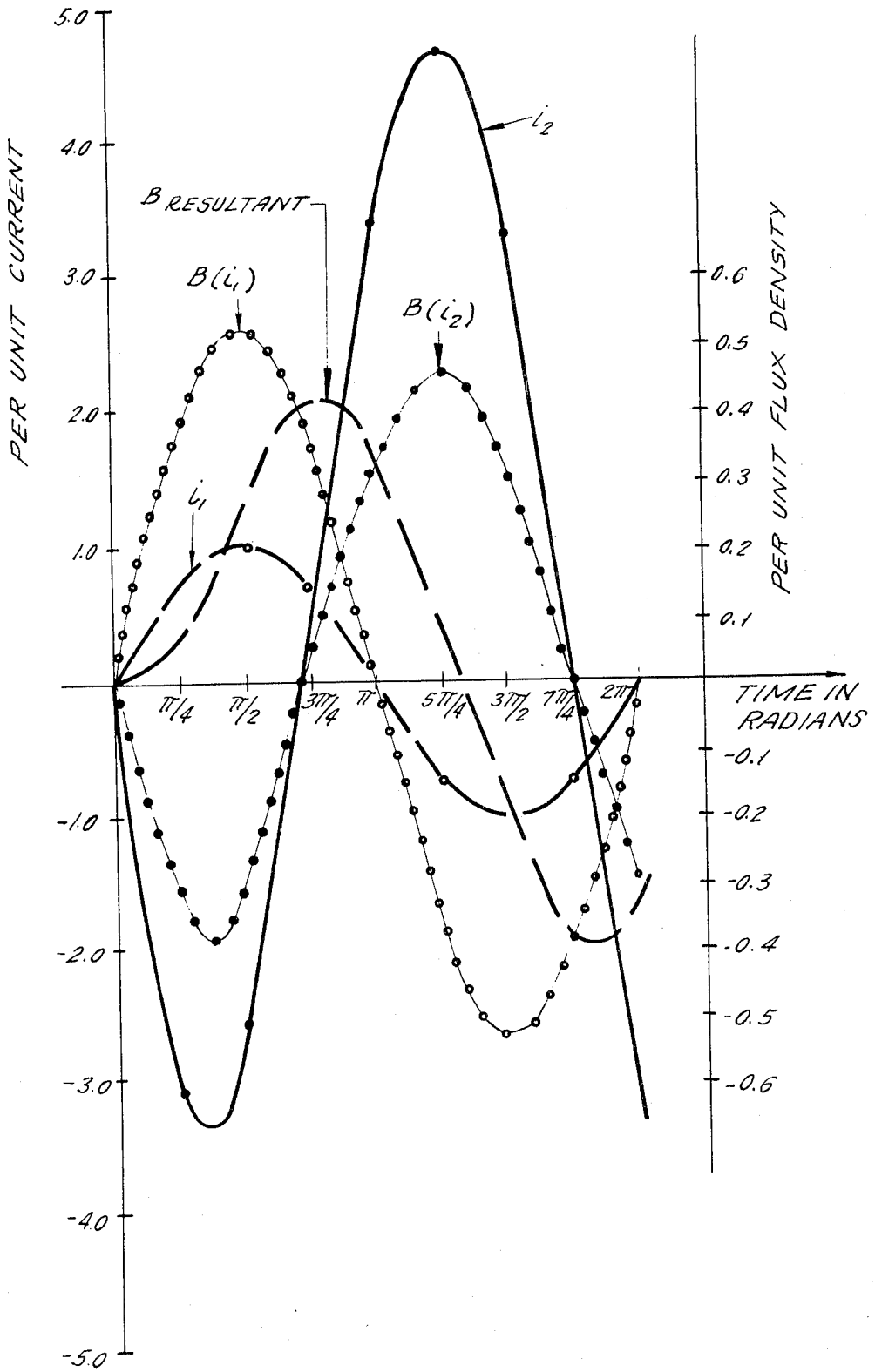
FIG. 13 is a plot of the arc current and induced arc runner current and of the magnetic fluxes produced by these currents in the arcing areas.

FIG. 13 shows as functions of time:

a. The current $i_1$, arc/coil current, and $i_2$, arc runner induced current, as solid lines.
b. The flux densities $B(i_1)$ and $B(i_2)$ as dotted lines, and
c. The resultant flux density, $B_{Resultant}$, a dashed line.

The resultant flux $B_{Resultant}$, is phase-shifted from the arc current, $i_1$. The vector Lorentz Force F on the arc is:

$\bar{F}=\bar{I}\times\bar{B}_{Resultant}$, where $\bar{I}$=Vector current in the arc $\bar{B}_{Resultant}$=The flux density vector at the arc.

For an interrupter with a phase-shift between the flux density and arc current, the force on the arc is directly proportional to the square of the arc current, so that the force drops off rapidly as the current in the arc approaches zero. Thus, the interrupting effort is not great around current zero when it is most needed.

An interrupter with a phase-shifted flux density produces a higher force on the arc near current zero. Thus, if the flux density around current zero is high, and is assumed to be nearly constant, the force on the arc is proportional to the arc current (rather than its square). Thus, the Lorentz force remains higher around current zero than the non-phase-shifted case.

Figure 14:
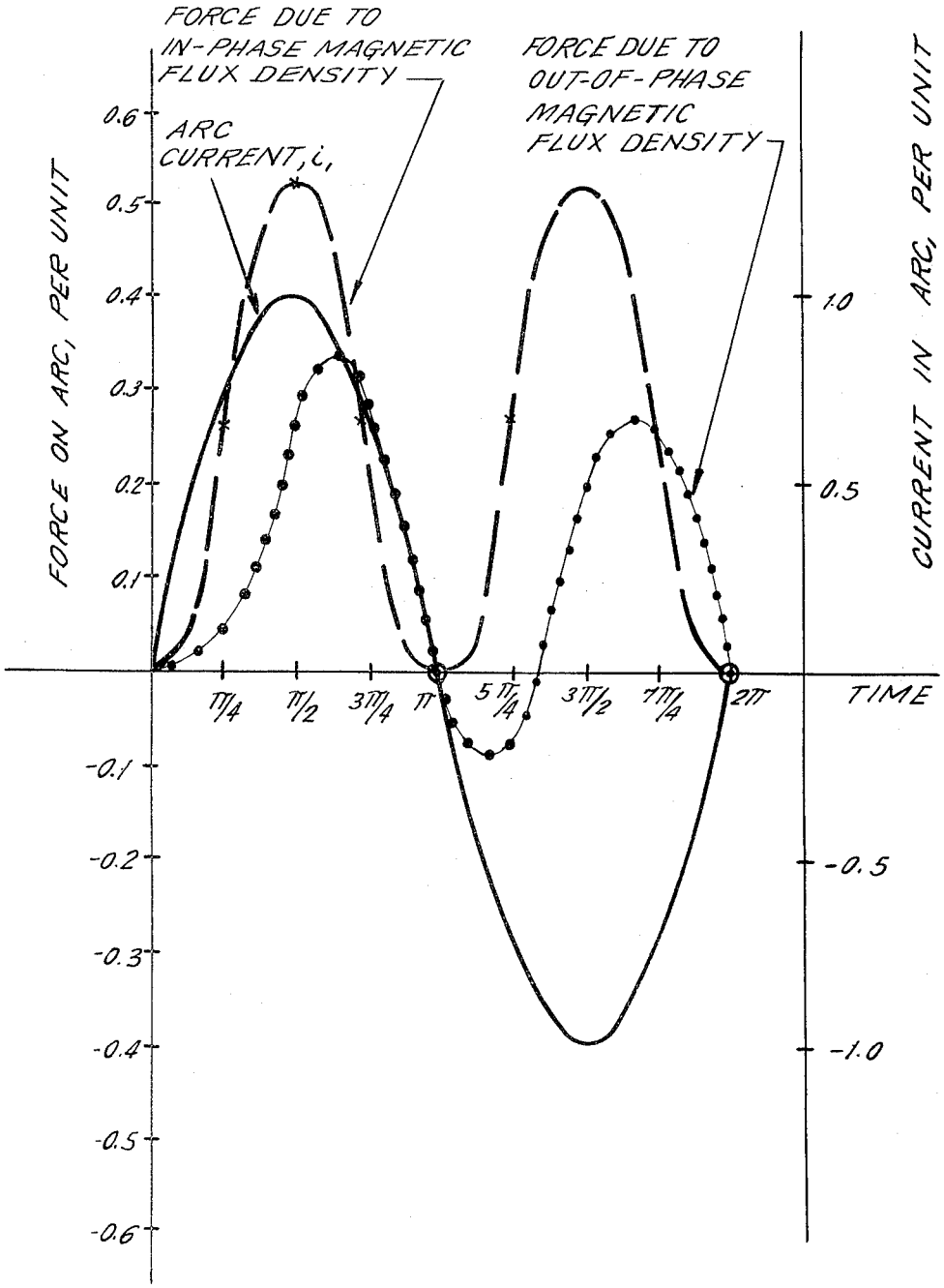
FIG. 14 illustrates the rotational force applied to the arc current due to in-phase magnetic flux and out-of-phase magnetic flux relative to the phase of the arc current.

The comparison is shown in FIG. 14 for the force produced by an in-phase flux (in a dashed line) and an out-of-phase flux (in a dotted line). The arc current is shown with a solid line. The current induced in the arc runner produces a higher force on the arc near current zero and thus increases the arc velocity, improves arc cooling and results in improved arc interrupting performance.

The present invention is to optimize the coil assembly by providing maximum force on the arc near current zero. This has been done in the past by maximizing the value of current $i_2$ induced in the arc runner near the time at which the arc current becomes zero. This current value is illustrated in FIG. 2 as current $I_2$ at $i_1=0$. Equation (4) would enable one to specify the arc runner dimensions such that R and L will be the values to produce the maximum value of $I_2$ at $i_1=0$. However, this choice of arc runner dimensions will not yield the optimum force on the arc.

The arc terminal on the arc runner 143 is the closest part of the arc to the coil assembly and will thus experience the highest magnetic flux density and resulting Lorentz force. The thickness of arc runner 143 separates the arc from the coil. Arc runner thickness will thus have a significant effect on the flux density per unit of coil current produced by the coil 150 at the arc terminal since the flux density is inversely proportional to the distance from the source. Moreover, runner thickness also affects the flux density per unit of arc runner current $i_2$ produced at the arc terminal. As the arc runner 143 becomes thinner, the current is crowded closer together and closer to a point on the surface where the arc terminates. Therefore, a higher magnetic flux density will be observed at the runner surface for a thinner runner with the same current. An increase in magnetic flux density due to coil 150 at the arc terminal on the runner 143 is thus observed when the runner thickness is decreased from the value which produces the maximum value of induced current at the arc current zero.

The effect of arc runner thickness is illustrated by the following example.

Figure 15:
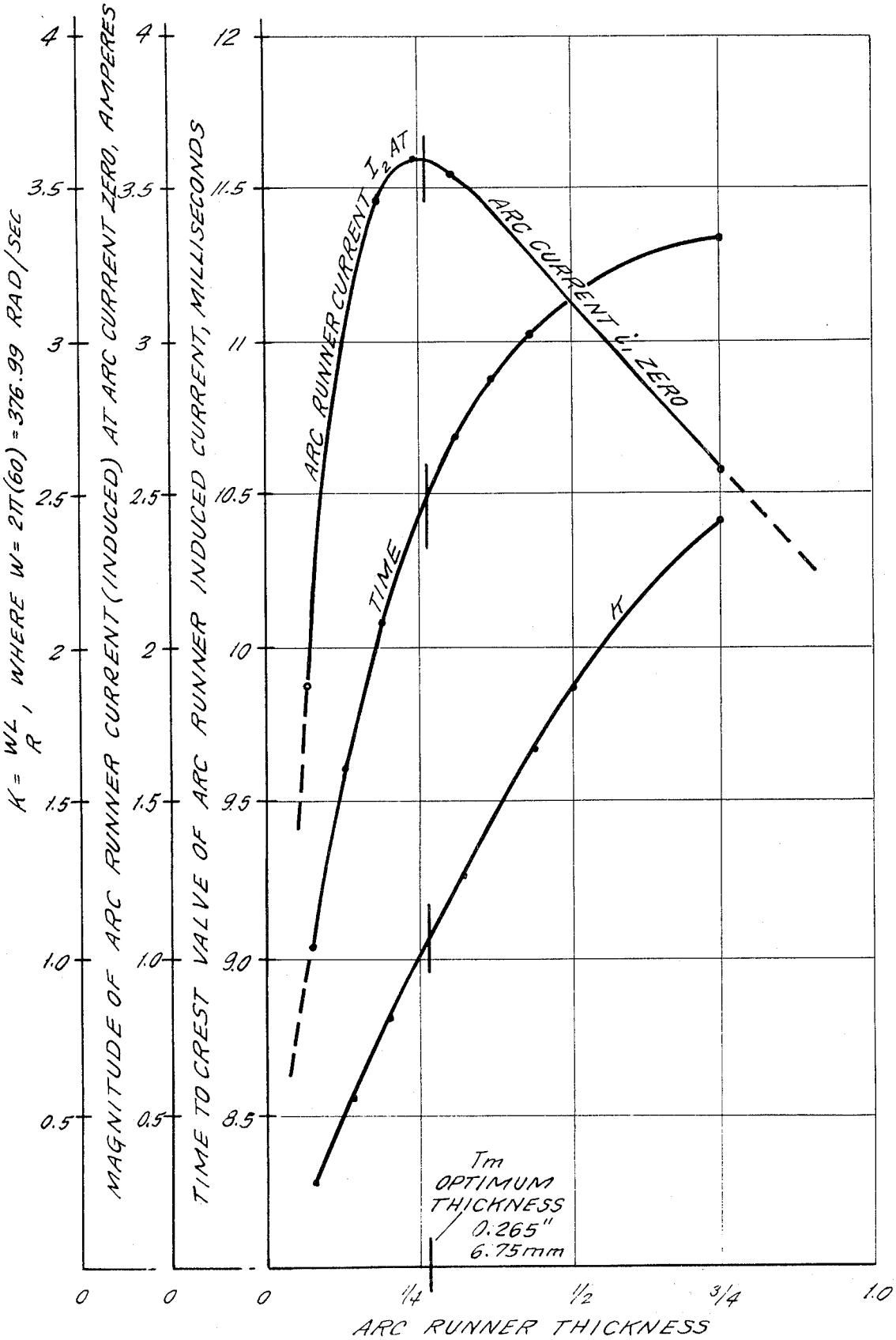
FIG. 15 illustrates the induced current in the arc runner at arc current zero as a function of the thickness of the arc runner.

The arc runner thickness Tm, which produces the maximum induced current magnitude $I_2$ at the zero arc current $i_1$ is shown in FIG. 15 to be 0.265 inches (6.73 millimeters) for a particular coil geometry in which an eleven turn winding wound of a flat spirally wound flat conductor was arranged, substantially as shown in FIG. 10. The curve of FIG. 15 was generated by mathematically analyzing the induced current in the arc runner.

Figure 16:
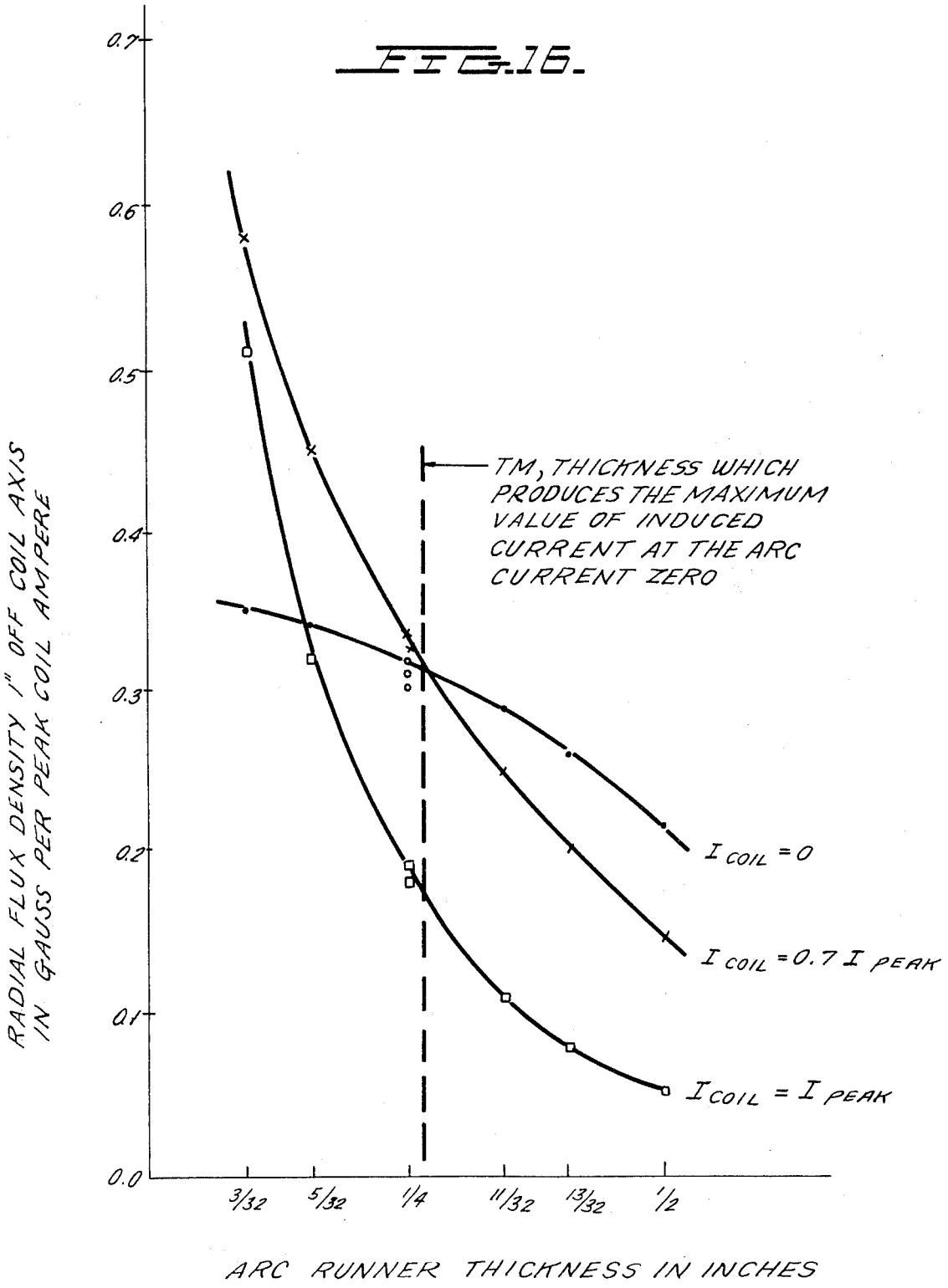
FIG. 16 illustrates the experimentally determined flux density one inch off the coil axis for different arc runner thicknesses.

A test model was constructed with the coil of the dimensions used for the analysis in FIG. 15. Arc runners of various thicknesses were used with this coil and the magnetic flux density was measured. FIG. 16 shows the measured magnetic flux density near the arc runner surface plotted as a function of arc runner thickness. Thicknesses less than Tm are shown to produce higher values of per unit flux density. Increases are moderate for the flux density measured at zero arc current; however, dramatic increases are observed at the arc current peak and at 70% of the arc current peak.

In accordance with the invention, an arc runner thickness less than Tm is selected to produce a higher magnetic flux density, and a higher Lorentz force on the arc in the neighborhood of current zero for the arc current.

A balance must be maintained between the desire to produce a large magnetic flux density from the coil assembly and the need to provide sufficient mechanical properties in the assembly which are affected by runner thickness. The arc runner 143 is repelled by the coil 150 as a result of the interaction between the induced current in the arc runner 143 and the magnetic field of the coil 150. The runner 143 is restrained from moving by mechanical connections at the runner inner and outer diameters, shown in FIG. 10. The mechanical strength of these connections and the arc runner itself must be sufficient to withstand these repelling forces.

Figure 17:
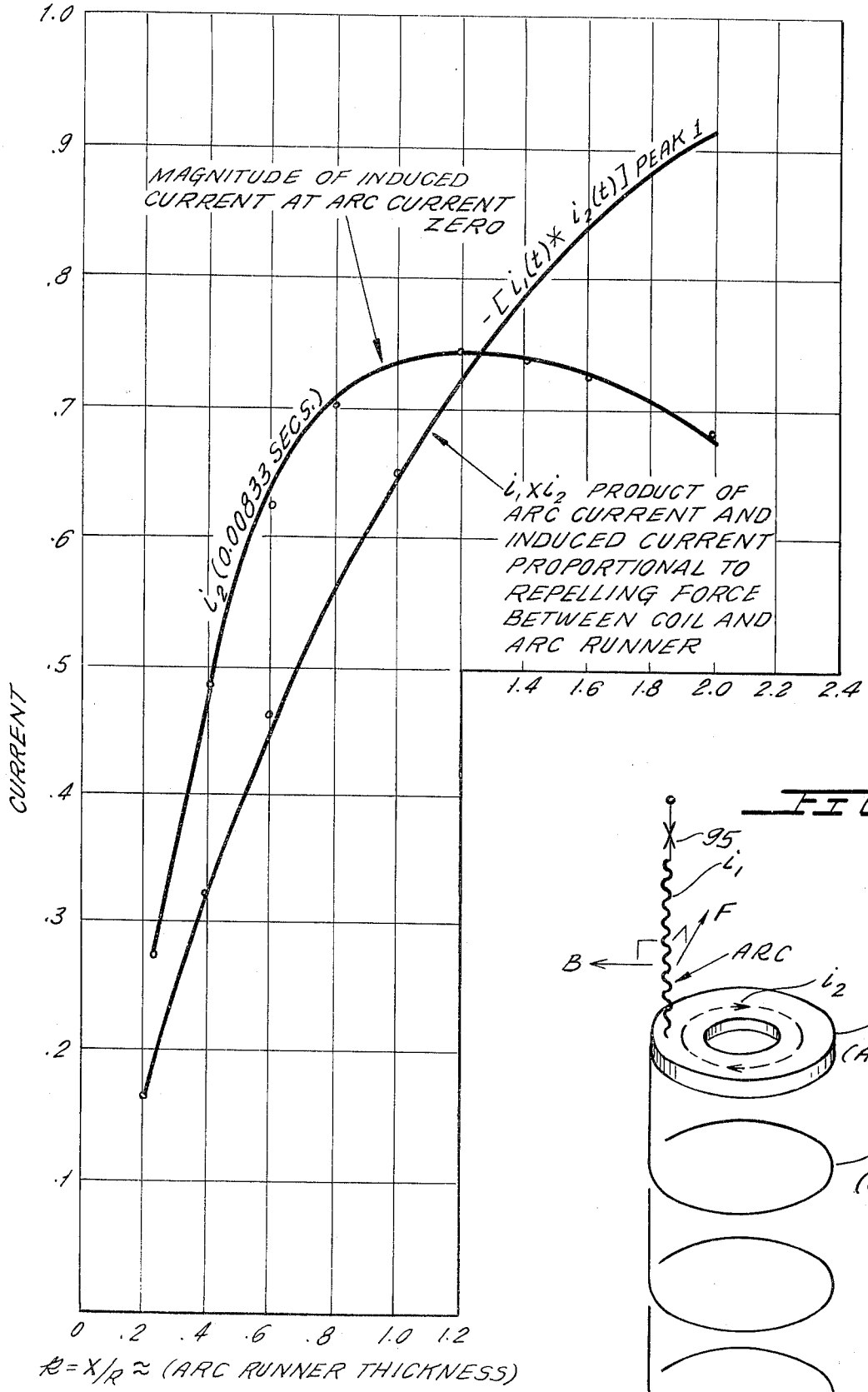
FIG. 17 illustrates repulsion forces which are produced between the coil and the arc runner as a function of arc runner thickness.

Mathematical analysis has shown that the repelling force is proportional to the arc runner thickness. This relationship is illustrated in FIG. 17, where the product $i_1\times i_2$ of the coil current $i_1$ and the arc runner current $i_2$ is plotted against the runner X/R ratio, which is closely proportional to arc runner thickness. Therefore, a reduction in arc runner thickness is accompanied by a reduction in repelling forces. However, the runner strength is also a function of the thickness and can be proportional to a power of the thickness. The mechanical strength can decrease more rapidly than the force. Thus, care must be exercised in choosing the thickness to maintain sufficient mechanical strength.

In summary, the arc runner thickness is selected, in accordance with the invention, by balancing several factors: The arc runner thickness Tm, which produces maximum induced current at the arc current zero will not produce an optimum design. An arc runner thickness less than Tm is used to produce higher magnetic flux density and improved interruption performance while maintaining assembly strength. This thickness will optimize performance of the coil assembly which is a key element in the gas-insulated magnetic arc spinning interrupter. In the present example, an arc runner thickness of about ⅛ inch was selected, even though maximum induced current $i_2$ is obtained with a thickness of 0.265 inches.

Although a preferred embodiment of this invention has been described, many variations and modifications will now be apparent to those skilled in the art, and it is preferred therefore that the instant invention be limited not by the specific disclosure herein but only by the appended claims.

We claim:

1. A circuit interrupter comprising a stationary contact assembly; a movable contact assembly; a dielectric gas filled housing containing said stationary and movable contact assemblies; said stationary contact assembly including an arc runner contact and an electrical coil and circuit connection means for connecting said electrical coil in series with said arc runner contact; said arc runner contact containing, as at least a portion thereof, a generally flat conductive disk having an axis which is coaxial with the axis of said coil; said coil being disposed adjacent one surface of said arc runner contact and being in a plane parallel to the plane of said arc runner contact and being closely magnetically coupled to said arc runner contact; said movable contact assembly including a generally cylindrical arcing contact which is coaxial with said arc runner contact, and which is movable into and out of contact with the surface of said arc runner contact which is opposite to said one surface; said arc runner contact having a thickness of less than about 0.285 inch, and said thickness being such as will produce maximum magnetic flux at arc current zero in a region adjacent said opposite surface of said arc runner contact due to the mutual coupling with said coil.

2. The circuit interrupter of claim 1 wherein said coil is a spiral wound winding.

3. The circuit interrupter of claim 1 wherein the outer diameter of said arc runner contact is covered with a solid dielectric material.

4. The circuit interrupter of claim 1 wherein the center of said opposite surface of said arc runner contact is covered with a solid dielectric.

5. The circuit interrupter of claim 1 wherein said dielectric gas at least includes $SF_6$.

6. The circuit interrupter of claim 1 wherein said circuit connection means is connected to the outer diameter of said arc runner contact, whereby the current path from said arc runner contact and into an arc extending from said arc runner contact to said arcing contact will execute a bend which produces a magnetic force which tends to bend the arc toward the axis of said arc runner contact.

7. An arc spinner interrupter comprising, in combination:

first and second electrical terminal means;

a movable contact movable along an axis, and between an engaged and a disengaged position;

annular arc runner means having at least a portion thereof disposed in a plane perpendicular to the direction of movement of said movable contact and having an axis which is coaxial with said axis of movement of said movable contact; said annular arc runner means being electrically engaged by said movable contact when said movable contact is in its said engaged position; said arc runner means defining a path for the annular rotation of the arc root of an arc which is drawn between said arc runner means and said movable contact when said movable contact moves to its said disengaged position;

dielectric gas filling the space which will be occupied by an arc drawn between said movable contact and said arc runner means;

magnetic field generating means for producing a magnetic field in said space, which field has at least one component which is perpendicular to said axis of said arc runner means, thereby to produce a Lorentz force which rotates said arc relative to said dielectric gas;

first circuit means connecting said movable contact to said first terminal means;

and second circuit means connecting said annular arc runner means to said second terminal means;

said arc runner means having a thickness of less than about 0.285 inch, and said thickness being such as will produce the maximum magnetic flux at arc current zero in a region of said space adjacent said arc runner means due to coupling with said magnetic field generating means.

8. The device of claim 7 which further includes housing means for enclosing said movable contact, said arc runner means, and said dielectric gas; said first and second terminal means being accessible externally of said housing means.

9. The device of claim 7 wherein said magnetic field generating means includes a winding which is coaxial with said arc runner means and which is closely coupled thereto and which is in series therewith, whereby a magnetic field is produced by the current through said winding, and by the current which is induced to circulate around said arc runner means.

10. The device of claim 7 wherein said winding is a spiral wound winding of flat conductive material which is wound in a plane which is parallel to the plane of said arc runner means.

11. The device of claim 10 wherein said second circuit means is connected solely to an exterior diameter region of said arc runner means, whereby the current path from said arc runner means to said arc is bent in a direction to produce a magnetic force which bends said arc toward said axis of said arc runner means.

12. The device of claim 11 wherein the outer periphery of said arc runner means is covered with a solid dielectric material.

13. The device of claim 12 wherein the center of said arc runner means is covered with a solid dielectric material.

14. An assembly of a coil and an arc runner for an arc spinner interrupter; said arc runner comprising a flat conductive disk portion having an exposed surface which defines an annular path for the movement of an arc root; said coil being coaxial with said arc runner and being disposed adjacent the opposite surfae of said arc runner; circuit means connecting said coil to said arc runner; said arc runner having a thickness of less than about 0.285 inches, said thickness being such as will produce the maximum magnetic flux at arc current zero in a region adjacent said exposed surface of said arc runner due to the mutual coupling with said coil.

15. The assembly of claim 14 wherein said circuit means connects one end of said coil to the outer diameter of said arc runner; said circuit means comprising the sole connection between said coil and said arc runner for connecting said arc runner and said coil in series.

16. The assembly of claim 15 wherein said connection to said arc runner outer diameter is made at a plurality of circumferentially spaced points on said outer diameter.

17. An arc runner for an arc spinner interrupter and a coil disposed to induce a circulating current in said arc runner; said arc runner comprising a flat conductive disk portion having a given resistance to flow of circulating current and a given inductance; said arc runner having a thickness such that the magnetic flux induced in a region adjacent a surface of said arc runner by said coil at arc current zero is a maximum, whereby the repulsive force between said rnner and said coil is reduced, said thickness being less than about 0.285 inch.

* * * * *